US006056521A

United States Patent [19]

Leu et al.

[11] Patent Number: 6,056,521

[45] Date of Patent: May 2, 2000

[54] TWO-CYLINDER AIR COMPRESSOR

[75] Inventors: Shawn Leu, Sheboygan; Jeffrey W. Bergner, Cedar Grove; Gregg E. Meschler, Sheboygan; William H. Lynn, Kohler; Larry H. Panzer, Sheboygan Falls, all of Wis.

[73] Assignee: Thomas Industries Inc., Sheboygan, Wis.

[21] Appl. No.: 09/199,123

[22] Filed: Nov. 24, 1998

Related U.S. Application Data

[63] Continuation-in-part of application No. 08/671,849, Jun. 28, 1996.

[51] Int. Cl.[7] ..... F04B 17/00

[52] U.S. Cl. ..... 417/423.14; 417/415; 417/521

[58] Field of Search ..... 417/415, 521, 417/372, 410.1, 423.14; 29/596

[56] References Cited

U.S. PATENT DOCUMENTS

| | | | |
|---|---|---|---|
| 1,126,959 | 2/1915 | Dawley | 417/251 |
| 1,282,482 | 10/1918 | Speasl | 92/147 |
| 3,083,308 | 3/1963 | Baumann | 417/350 |
| 3,094,272 | 6/1963 | McClure | 417/350 |
| 3,158,930 | 12/1964 | Wesstrom et al. | 29/510 |
| 3,664,772 | 5/1972 | Panariti | 417/521 |
| 3,865,221 | 2/1975 | Coty | 192/58 B |
| 3,932,070 | 1/1976 | Porter et al. | 417/423 |
| 3,961,868 | 6/1976 | Droege, Sr. et al. | 417/550 |
| 3,961,869 | 6/1976 | Droege, Sr. et al. | 417/555 R |
| 4,017,964 | 4/1977 | Schulte et al. | 29/596 |
| 4,105,374 | 8/1978 | Scharf | 417/415 |
| 4,458,405 | 7/1984 | Cavagnero et al. | 29/596 |
| 4,558,992 | 12/1985 | Hamano et al. | 417/250 |
| 4,584,750 | 4/1986 | Ozu et al. | 29/156.4 R |
| 4,810,174 | 3/1989 | Stuckey et al. | 417/423.14 |
| 4,834,626 | 5/1989 | Prevosto | 417/415 |
| 4,958,990 | 9/1990 | Gordon et al. | 417/410 |
| 5,006,047 | 4/1991 | O'Connell | 417/238 |
| 5,033,941 | 7/1991 | Jensen | 417/415 |
| 5,203,071 | 4/1993 | Niemela et al. | 29/596 |
| 5,228,196 | 7/1993 | Hara et al. | 29/888.022 |
| 5,246,356 | 9/1993 | Scarfone | 418/63 |
| 5,326,233 | 7/1994 | Mochizuki et al. | 417/350 |
| 5,584,675 | 12/1996 | Steurer et al. | 417/372 |

FOREIGN PATENT DOCUMENTS

| | | |
|---|---|---|
| 295 08 399 U | 8/1995 | Germany . |
| 7-310651 | 11/1995 | Japan . |
| 1 542 926 | 3/1979 | United Kingdom . |

OTHER PUBLICATIONS

Thomas Compressor Pump, Field Service Manual, 2619CGH147–932, Thomas Industries, Inc., 1996.

Joseph Shigley, Mechanical Engineering Design, 3rd Ed., McGraw–Hill, pp. 63–65, 1977.

*Primary Examiner*—Timothy S. Thorpe
*Assistant Examiner*—Michael K. Gray
*Attorney, Agent, or Firm*—Quarles & Brady LLP

[57] ABSTRACT

A two-cylinder air compressor has a motor with a through drive shaft. Identical housings are provided at each end of a cylindrical spacer sleeve that surrounds the motor. The housings include cylinder housing extensions each of which mounts a cylinder sleeve, a valve plate, and a head. The heads are part of a one-piece cylinder head member. Wobble pistons are mounted on each end of the motor shaft and operate in the cylinder sleeves. The cylinder sleeves rest on a floor in the housing which has integrally formed passages for cooling air to circulate around the cylinder sleeves. The one-piece cylinder head member includes integral tubes connecting the heads. The integral tubes span the distance between the heads and are spaced from the outside of the spacer. The housings may be joined by through bolts or without bolts by press fitting the bearings in the housing, press fitting the housings to the spacer sleeve, and press fitting the motor shaft into the bearings. The one-piece cylinder head serves as the final retention member, clamping the housings axially while maintaining radial orientation.

9 Claims, 9 Drawing Sheets

FIG. 3
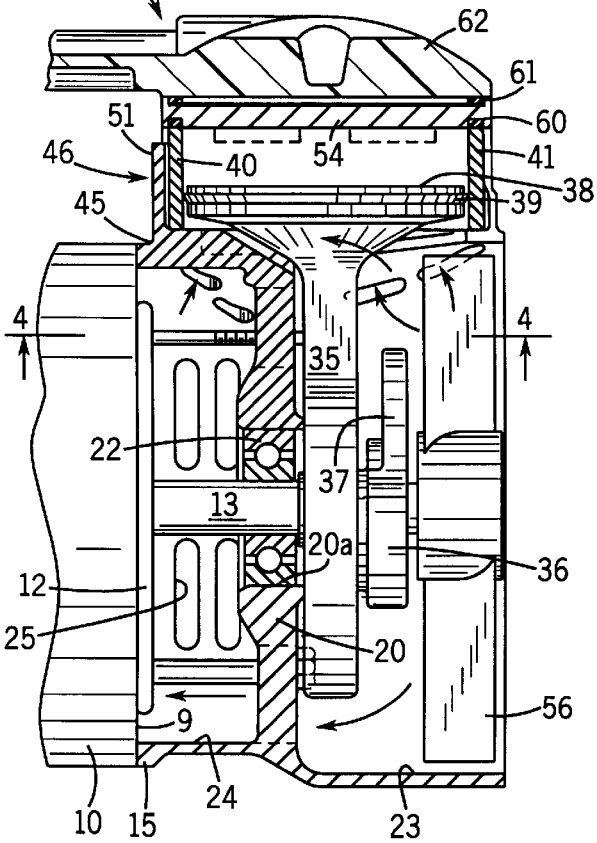
FIG. 5
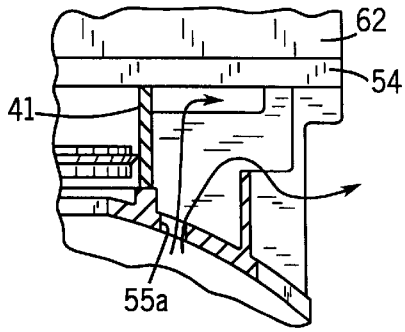
FIG. 6
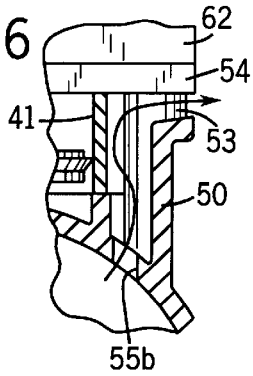
FIG. 7
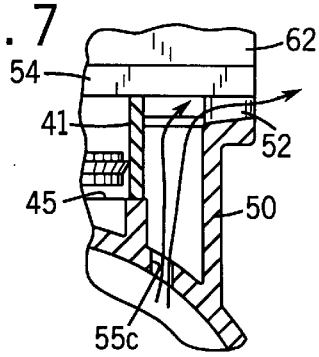
FIG. 8
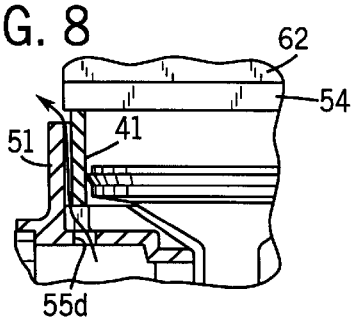
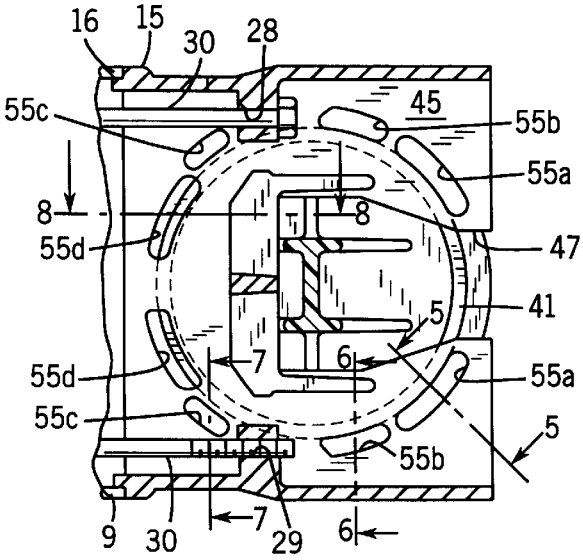
FIG. 4

TWO-CYLINDER AIR COMPRESSOR

RELATED APPLICATIONS

This application is a continuation-in-part of U.S. patent application No. 08/671,849, filed Jun. 28, 1996.

BACKGROUND OF THE INVENTION

This invention relates to air compressors, and particularly to an improved two-cylinder oilless air compressor.

A common form of air compressor employs a wobble piston driven by an electric motor. Examples are found in U.S. Pat. No. 3,961,868 issued Jun. 8, 1976, for "Air Compressor", 3,961,869 issued Jun. 8, 1976, for "Air Compressor", and 5,006,047 issued Apr. 9, 1991, for "Compressor With a Segmented Piston Rod Assembly", all of which are owned by the assignee of this invention.

The wobble pistons of such air compressors have a peripherally extending seal which mates with the bore of the cylinder. No lubricant is required between the piston head and the cylinder bore. However, the movement of the piston seal in the cylinder bore generates considerable heat which must be dissipated.

Two-cylinder, in-line oilless piston compressors are also known. In one form, the two cylinders are arranged at opposite ends of a motor having a through drive shaft that mounts a wobble piston on each end. Each cylinder has a valve plate with flapper intake and exhaust valves mounted opposite the piston head. A cylinder head with intake and exhaust chambers is mounted on each cylinder and provides inlet and outlet chambers to the cylinders. The inlet and exhaust chambers of the cylinder heads are typically connected by separate tubes. Examples of the two-cylinder, in-line compressors are the 2600 series of compressors of Thomas Industries, Inc., the assignee of this invention.

SUMMARY OF THE INVENTION

It is an object of the invention to provide an improved two-cylinder, in-line, oilless compressor in which the cylinders are formed in identical housings attached at either end to a cylindrical spacer that encircles the motor.

It is another object of this invention to provide such a air compressor in which the identical housings include integrally formed passages for cooling air to circulate around the exterior of the cylinders.

It is yet another object of this invention to provide such an air compressor having a one-piece cylinder head member which includes the cylinder heads for both cylinders and the integral tube connector between the chambers of the heads, the integral connectors being capable of acting as a handle or hook for the air compressor.

It is a further object of the invention to provide a method of assembling a two-cylinder air compressor that eliminates the need for bolts or screws.

In accordance with the invention, an air compressor has a motor with a through drive shaft. A cylindrical spacer or sleeve encircles the motor and identical housings are mounted at each end of the motor sleeve. Each housing includes a central bearing retainer which mounts a bearing for a respective end of the shaft. Each housing also mounts a cylinder. A piston having a rod attached eccentrically to the shaft has a head operating in the cylinder.

Further in accordance with the invention, the identical housings have a cylinder extension projecting transversely to the axis of the motor shaft. The cylinder comprises a circular cylinder sleeve supported on a floor of the extension and spaced from the walls the extension. Each housing has a hollow interior that accommodates a fan mounted on the motor shaft. Air passages are formed in the housing through the floor of the extension for the circulation of air by the fan to the space between the cylinder sleeve and the walls of the extension.

Also in accordance with the invention, an air compressor includes a motor having a through drive shaft, housings mounted at each end of the motor and including a cylinder, a piston attached to each end of the shaft and operating in the respective cylinder, and a one-piece head member for both cylinders. The head member includes a head at each end for mounting to the cylinders, and integral tubes connecting the heads and spanning the distance between the housings.

The invention also resides in a boltless air compressor and in a method of assembling such an air compressor that involves press fitting a bearing in each housing, press fitting one housing with its bearing onto one end of the motor sleeve, press fitting one end of the motor shaft into the bearing in the housing attached to the motor sleeve, press fitting the other housing with its bearing onto the other end of the motor sleeve while press fitting the other end of the motor shaft into the bearing in the other housing, and joining the housings with a one-piece cylinder head.

The foregoing and other objects and advantages of the invention will appear in the following detailed description. In the detailed description, reference is made to the accompanying drawings which illustrate a preferred embodiment of the invention.

BRIEF DESCRIPTION OF THE DRAWINGS

FIG. 3 is a view in vertical section through one end of the air compressor;

FIG. 4 is a view in horizontal section taken in the plane of the line 4—4 of FIG. 3;

FIG. 5 is an enlarged view in section taken in the plane of the line 5—5 of FIG. 4;

FIG. 6 is an enlarged view in section taken in the plane of the line 6—6 in FIG. 4;

FIG. 7 is an enlarged view in section taken in the plane of the line 7—7 in FIG. 4;

FIG. 8 is an enlarged view in section taken in the plane of the line 8—8 in FIG. 4;

DETAILED DESCRIPTION OF THE PREFERRED EMBODIMENT

Figure 1:
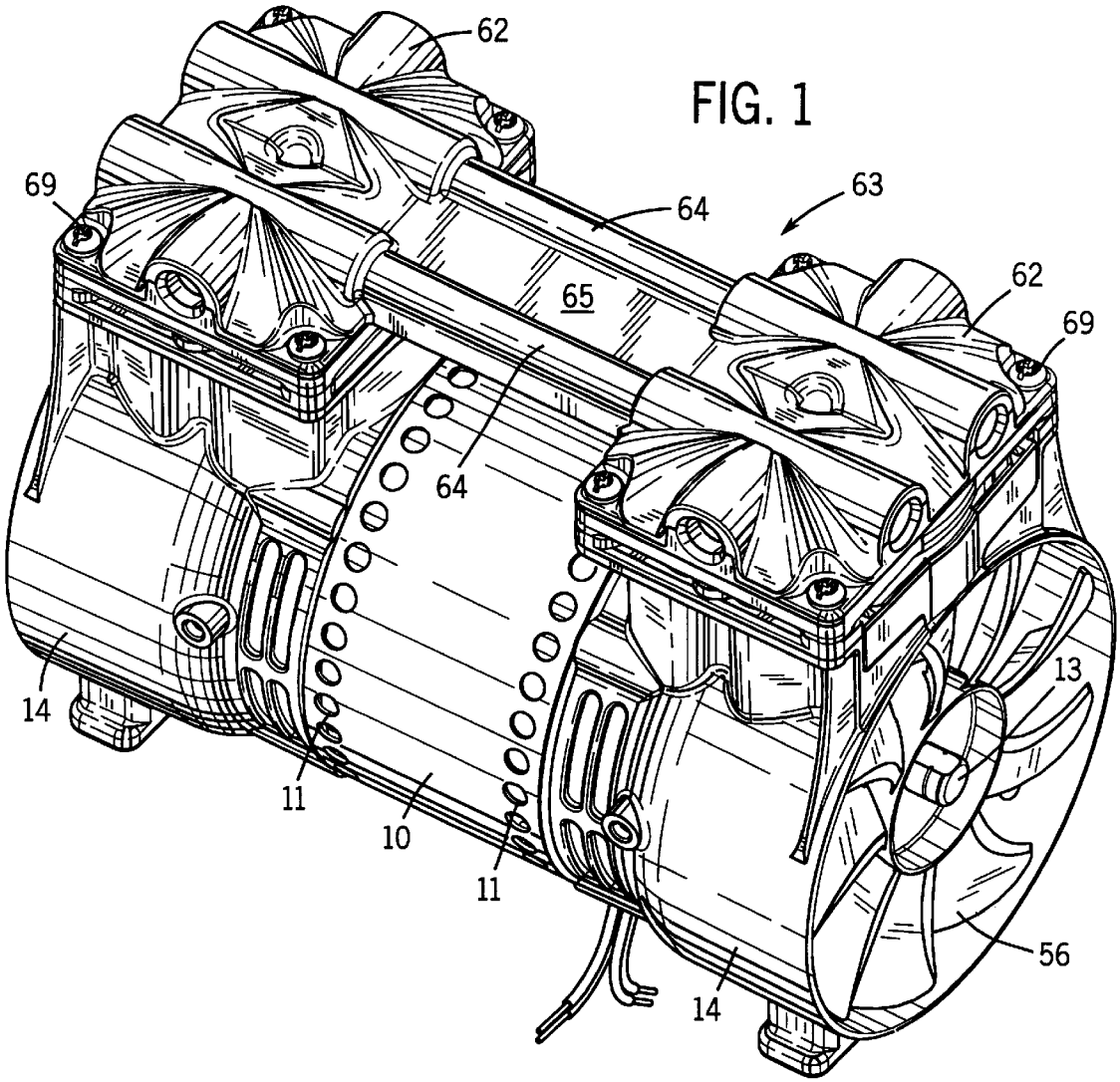
FIG. 1 is a view in perspective of an air compressor in accordance with the invention.

The air compressor includes a circular cylindrical thin wall spacer or sleeve 10 having perforations 11 adjacent its ends for purposes of air flow. The sleeve 10 encircles an electric motor 12 having a through drive shaft 13. Identical end housings 14 are joined to the motor sleeve 10. The housings 14 are preferably formed of a cast material, such as aluminum. The housings 14 include a circular flange 15 at one end that is machined with a rabbet or relief 16 that receives the end 9 of the motor sleeve 10, as shown in FIG. 3.

The housings 14 are formed with an internal bearing retainer portion 20 that is at the center of a series of spokes 21. The bearing retainer 20 has a central bore 20*a* that mounts the outer race of a ball bearing 22 which receives the motor drive shaft 13. The bearing retainer 20 and spokes 21 divide the housing into an outer enlarged cylindrical position 23 and an inner smaller cylindrical portion 24. The reduced diameter portion 24 has a series of optional air openings 25 about its perimeter.

Figure 9:
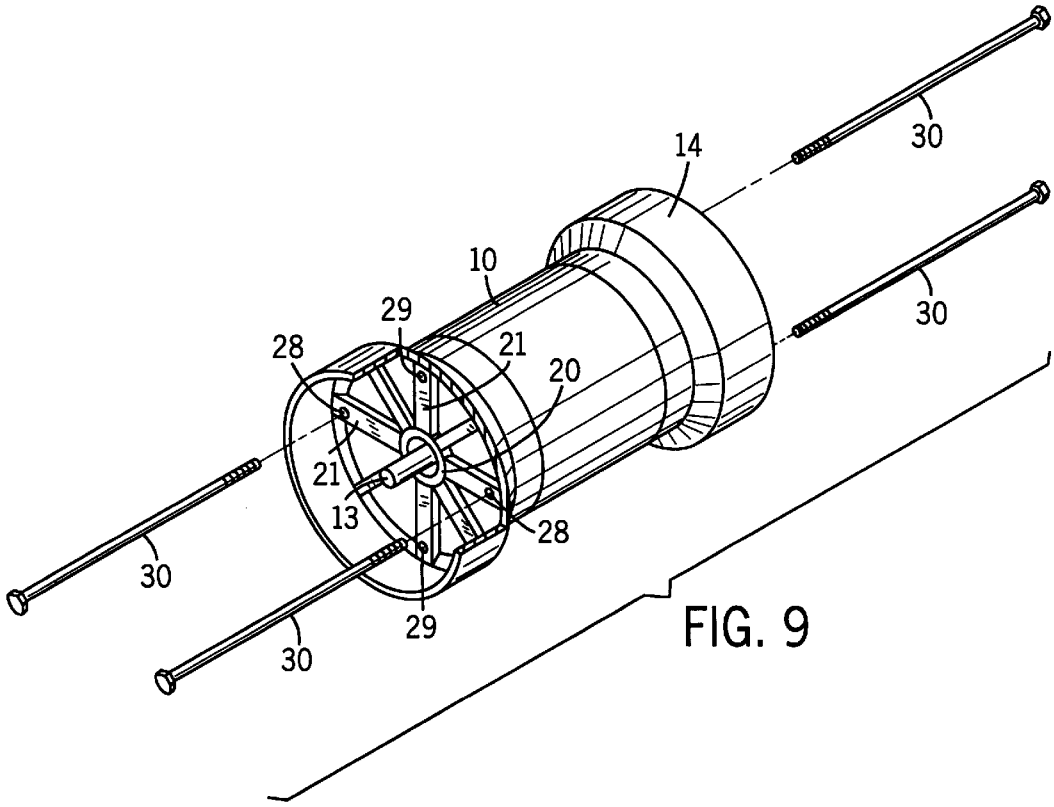
FIG. 9 is an exploded perspective view showing the joining of the housings to the spacer.

As shown in FIG. 9, the spokes 21 are offset 45 degrees from each other. Opposite pairs of the spokes 21 are provided with openings 28 and 29. The openings 28 are through holes while the openings 29 are tapped holes. With the identical housings 14 arranged end-to-end on the spacer 10, the through holes in one housing 14 will line up with the tapped holes in the other housing 14. Threaded bolts 30 extend through the through holes 28 and are threaded into the tapped holes 29 to join the housings 14 to the spacer 10.

A wobble piston 35 is mounted on the projecting end of the motor shaft 13 outbound of the bearing 22 in a conventional manner. That is, an eccentric 36 is mounted to the shaft 13 and the piston 35 is mounted on the eccentric 36 with its axis offset from that of the motor drive shaft 13. The eccentric 36 includes a counterweight 37. The piston head 38 has a peripheral seal 39 formed of a Teflon cup. The seal 39 seals with the bore 40 of a cylinder sleeve 41. The cylinder sleeve 41 is supported on a floor 45 in a cylinder extension 46 of the housing 14. As shown in FIG. 4, the floor 45 has an opening 47 to accommodate the piston 35 and the cylinder sleeve 41.

The cylinder extension 46 has sidewalls 50 and an endwall 51 that are spaced from the outside of the cylinder sleeve 41. The sidewalls 50 terminate in bosses 52 and 53 which extend upwardly and which mount a valve plate 54. As shown in FIG. 3, the walls 50 and 51 terminate short of the top of the cylinder sleeve 41. The valve plate 54 may be typical construction and includes inlet and exhaust flapper valves (not shown).

Each housing 14 is provided with a series of openings 55*a*, 55*b*, 55*c*, and 55*d* which extend through the floor 45 of the cylinder extension 46 in a generally circular array about the location of the cylinder sleeve 41. A fan 56 is mounted on the end of the motor drive shaft 13 within the hollow interior of the housing 14. The fan 56 draws air into the housing 14 towards the motor 12 to cool the motor. The fan 56 also draws air from the outside and passes it through the openings 55*a*, 55*b*, 55*c*, and 55*d* to the space surrounding the exterior of the cylinder sleeve 41 thereby cooling the cylinder sleeve. The paths of air through the openings 55*a*, 55*b*, 55*c*, and 55*d* are shown in FIGS. 5 through 8.

Figure 11:
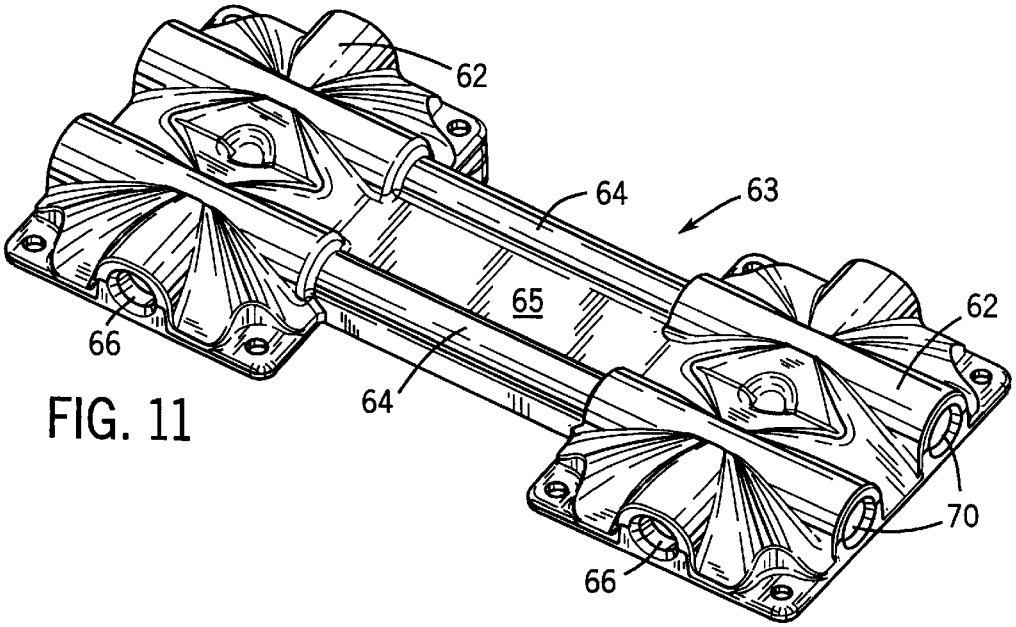
FIG. 11 is a top view in perspective of the one-piece head member.
Figure 2:
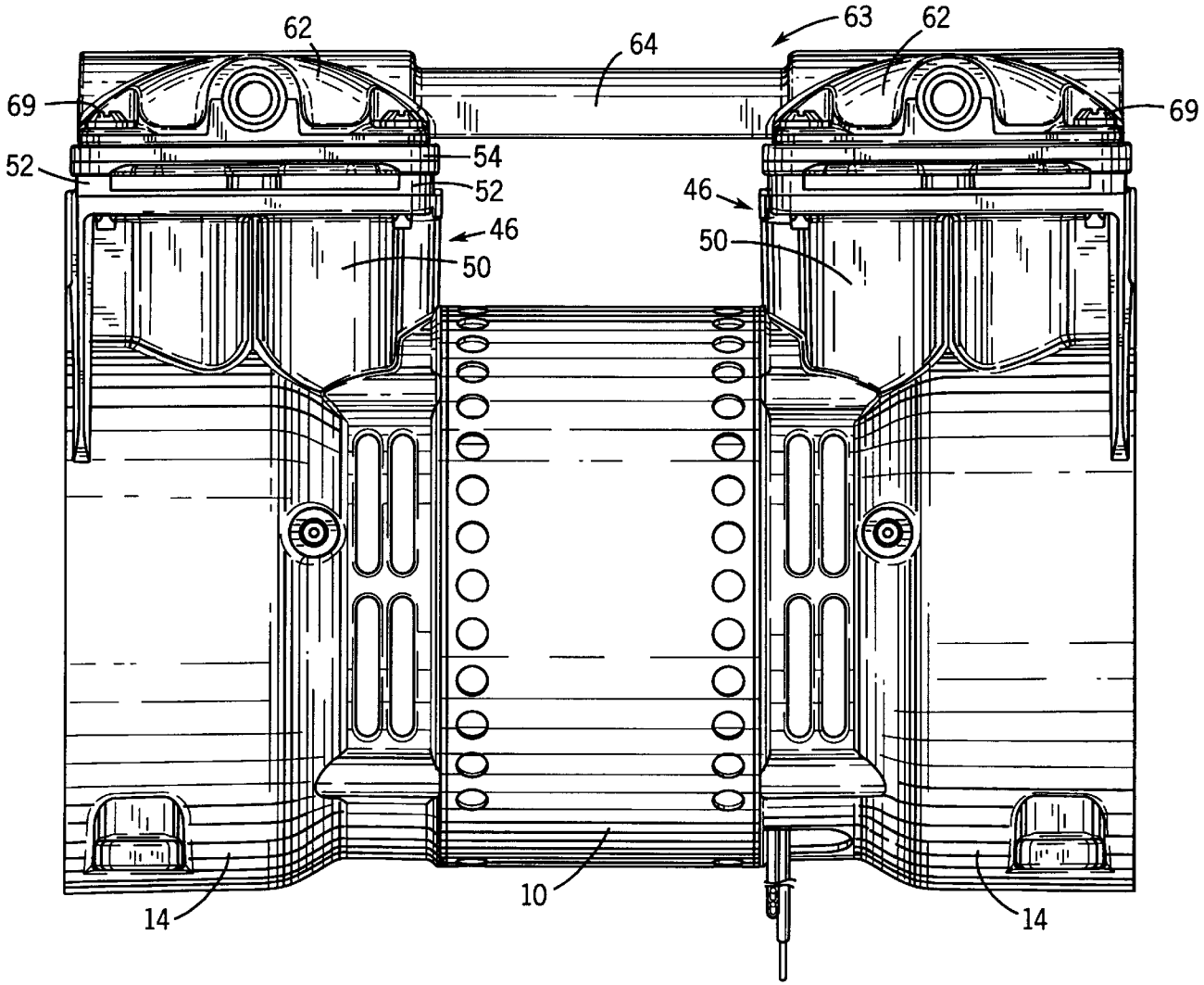
FIG. 2 is a view in elevation of the air compressor of FIG. 1.
Figure 10:
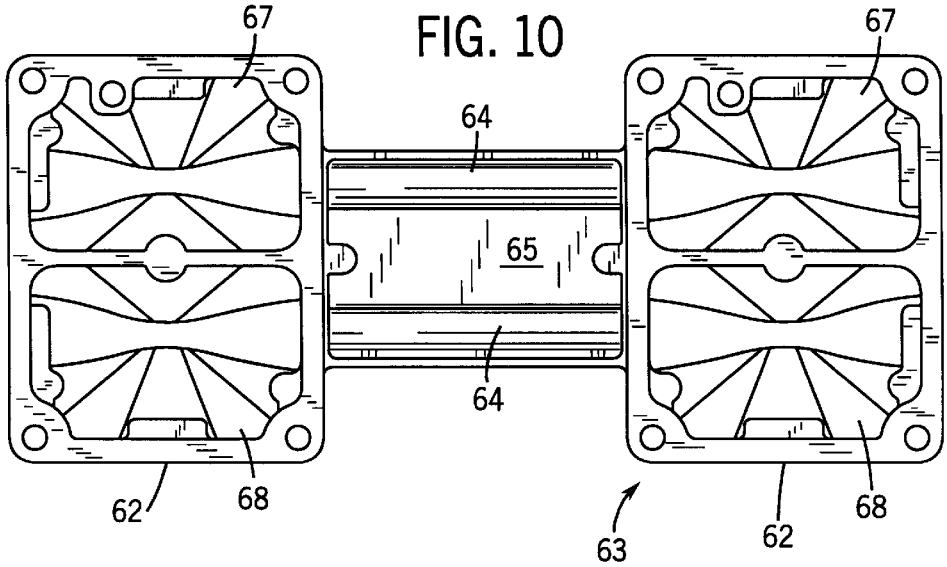
FIG. 10 is a bottom plan view of the one-piece head member.

As shown in FIG. 3, the valve plate 54 mounts an O-ring type seal 60 that seals against the top edge of the cylinder sleeve 41. The valve plate 54 also includes an upper O-ring type seal 61 that seals with the bottom surface of a head portion 62 of a head member 63. As shown in FIGS. 10 and 11, the head member 63 has head portions 62 at each end. The head portion 62 are joined by an integral connector which includes spaced hollow tubes 64 and a web 65 joining the tubes 64. The hollow tubes 64 connect to the inlet and exhaust chambers 67 and 68 of the head portions 62. The head portions 62 are bolted to the bosses 52 of the cylinder extension 46 of the housings 14 by screws 69. The head portions 62 also have openings 66 that are either open or plugged for external connections to the necessary piping to and from the chambers 67 and 68. The connector formed by the integral tubes 64 and web 65 spans the distance between the head portions 62. As shown in FIG. 2, the tubes 64 and web 65 are spaced from the spacer 10 so that the connector can act as a handle or a hook for supporting the air compressor. The head member 63 is also preferably formed of a cast aluminum.

The construction of the compressor of this invention lends itself to assembly without the use of bolts or screws. This is accomplished by using a press fit between the ends of the motor shell and the rabbets or reliefs 16 in the housings, by a press fit of the to the motor shaft, by a press fit between the bearings and the housing bores, and by the one-piece head.

Figure 12:
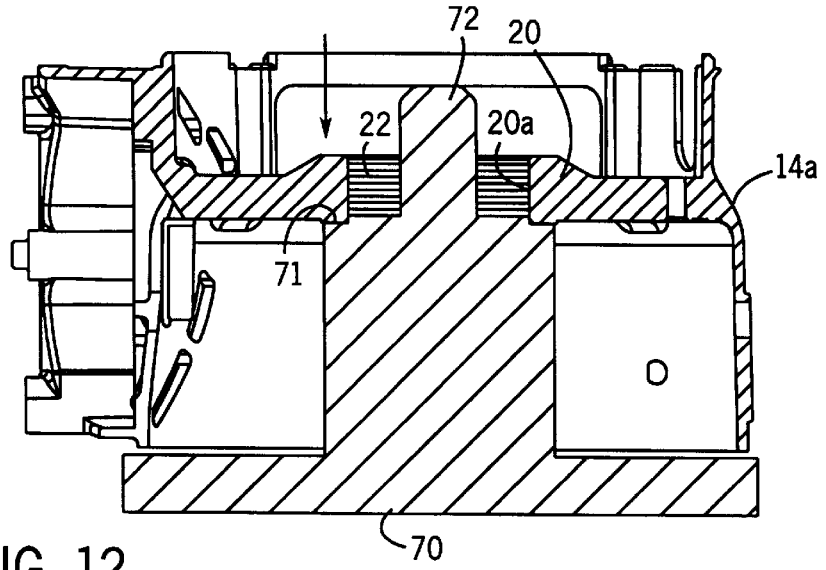
FIGS. 12 through 17 are views in section which illustrate the steps of assembling the two-cylinder air compressor using press fits.

The manner of assembling a boltless compressor is illustrated in FIGS. 12 through 17. In these figures, the bearings 22 are shown in stylized form. Referring to FIG. 12, the assembly begins by press fitting a bearing 22 into one of the housings 14*a*. This is accomplished using a fixture 70 having a land 71 which supports the outer side of the bearing retainer 20 adjacent its perimeter. The fixture 70 has a central projection 72 which extends through the inner race of the bearing 22. The bearing 22 is forced into the central bore 20*a* until it bottoms against a surface 73 which is disposed at a distance of a few hundredths of an inch from the land 71 against which the bearing retainer 20 rests.

Figure 13:
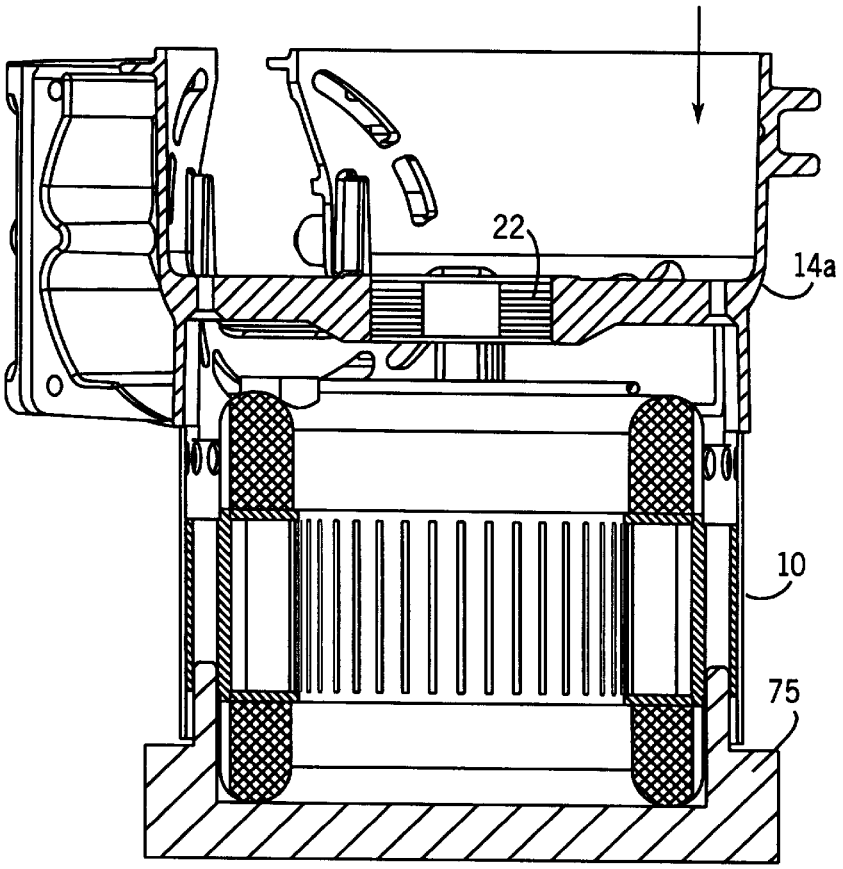

The one housing 14*a* with the bearing 22 in place is then assembled to a motor stator and shell subassembly 74 using a further fixture 75, as shown in FIG. 13. The fixture 75 supports the stator shell subassembly 74 while pressure is applied to the housing 14*a* to press fit the rabbet 16 of the housing 14*a* onto the motor shell 10.

Figure 14:
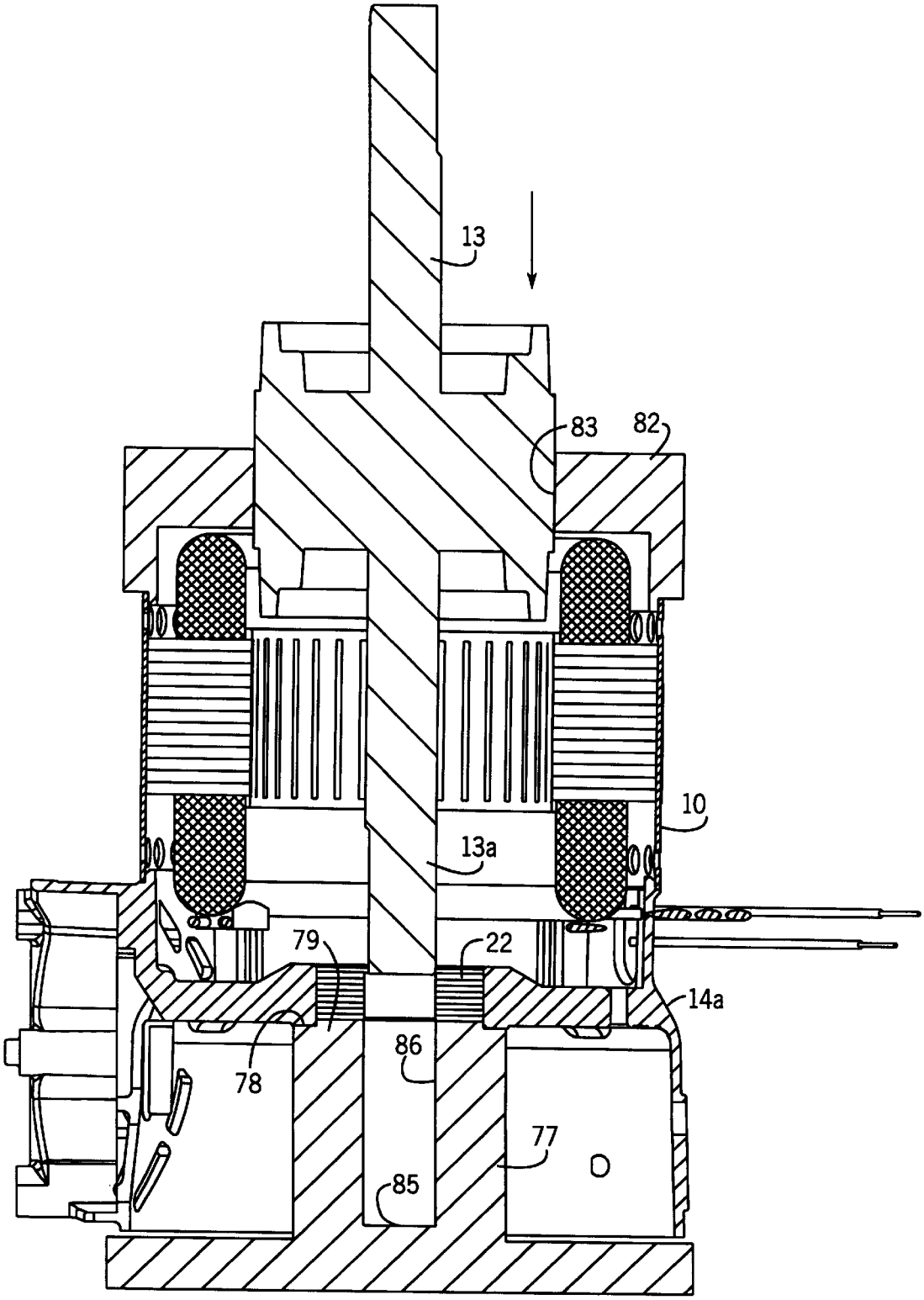
Figure 15:
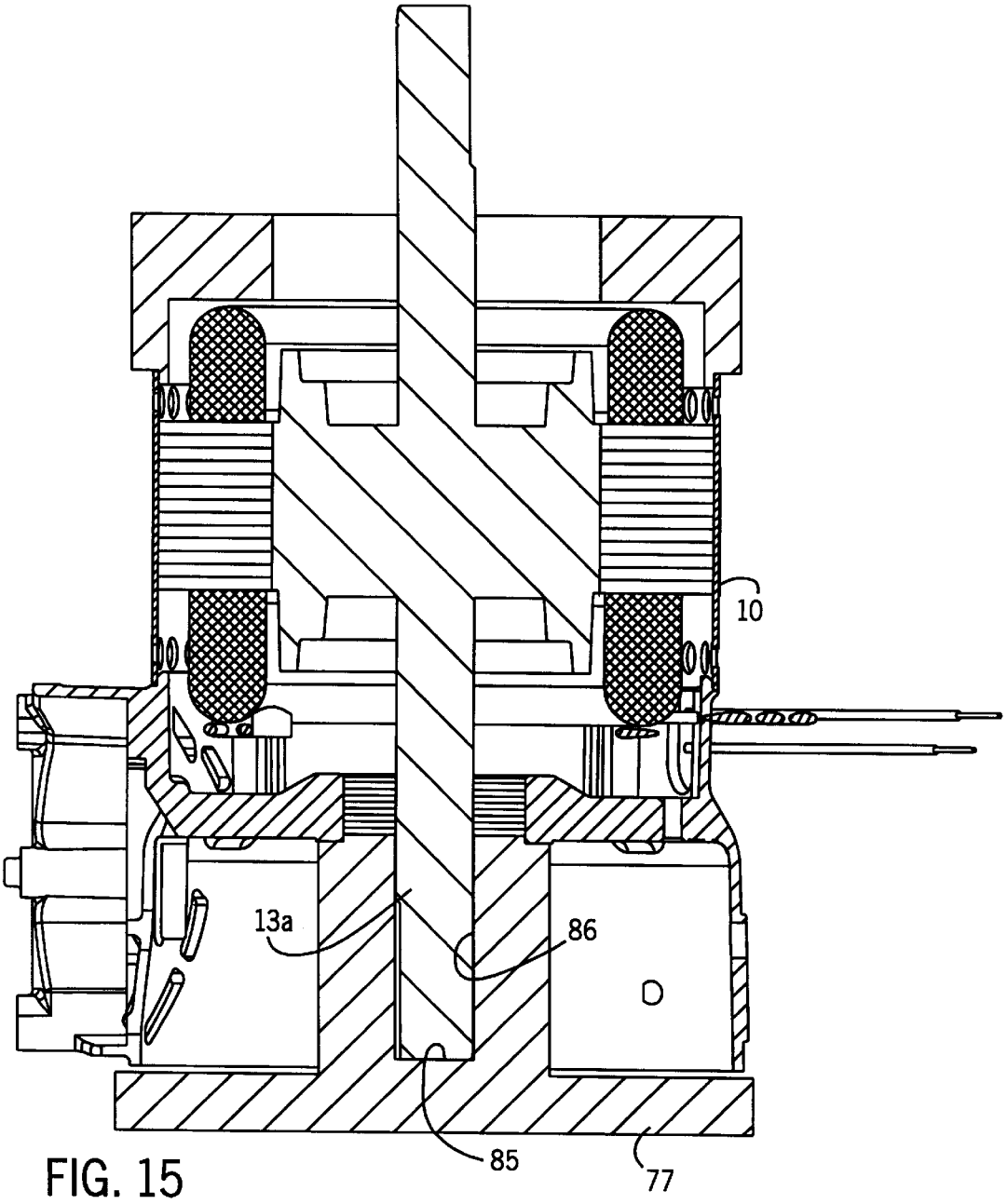
Figure 16:
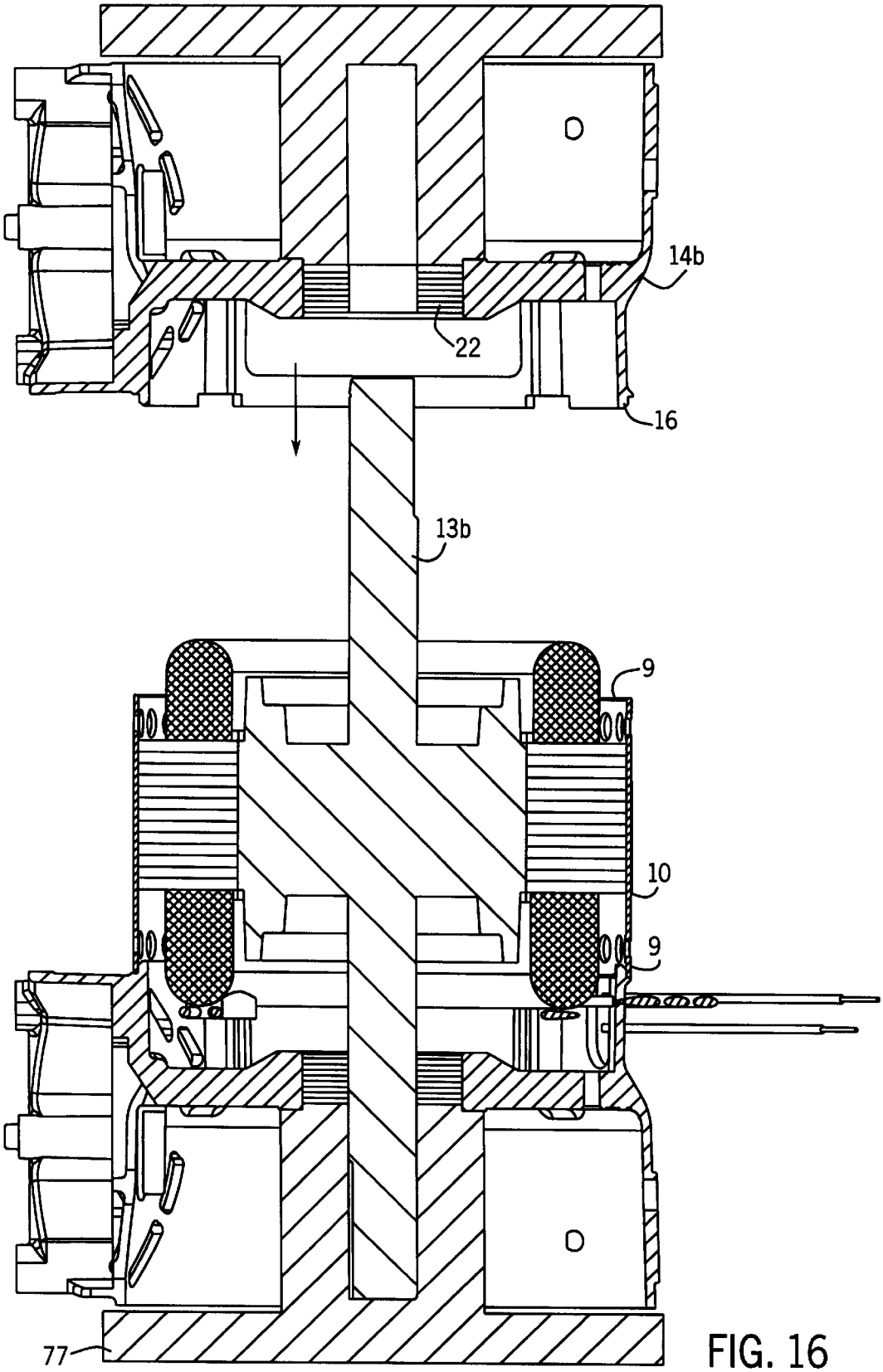
Figure 17:
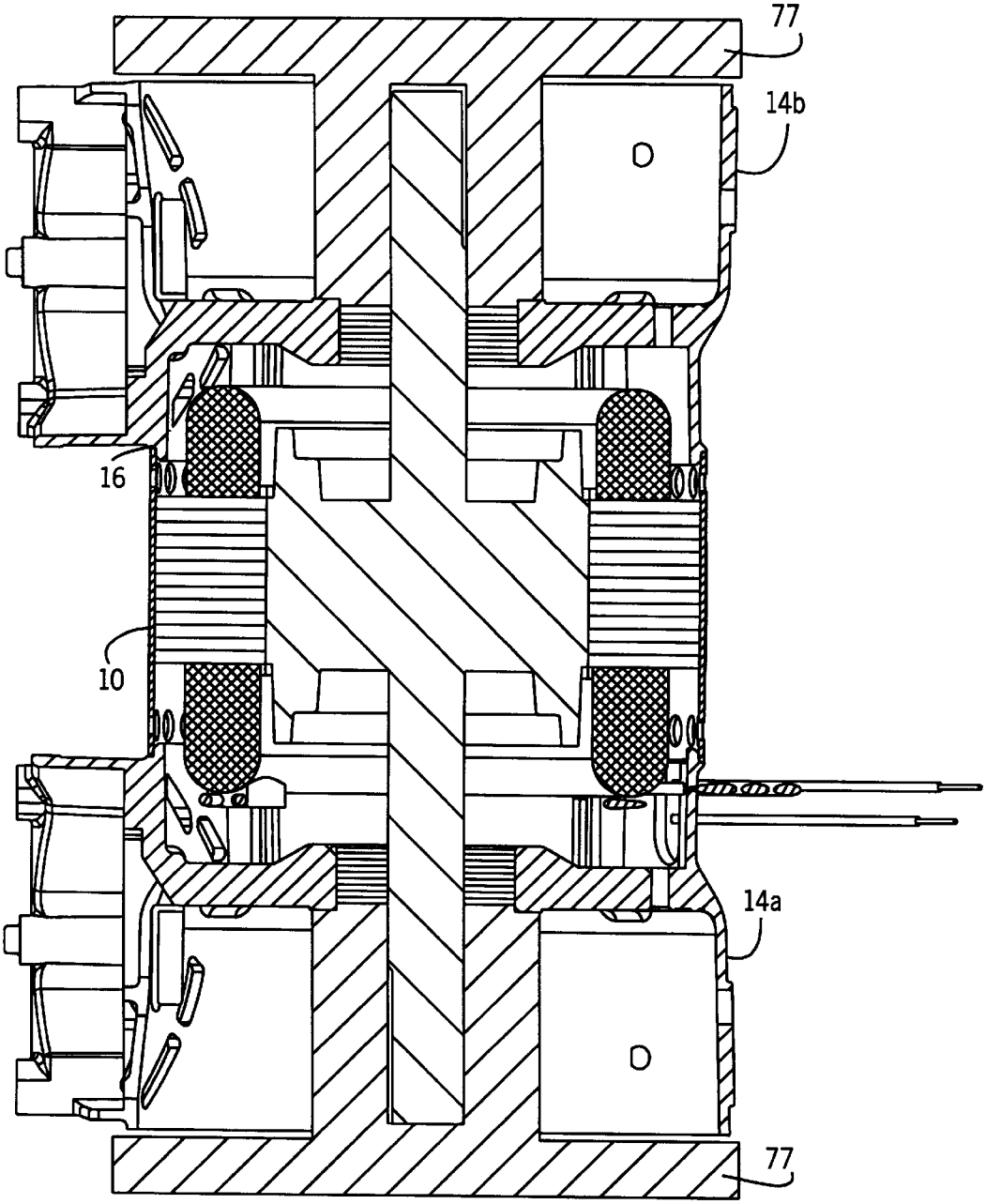

The housing 14*a* with the motor shell assembly 74 attached is turned over and mounted in a further fixture 77 which has the same series of surfaces 78 and 79 as in the fixture 70. A guide 82 is mounted on the opposite end of the shell 10. The guide 82 has a central opening 83 which receives the motor shaft 13, as shown in FIG. 14. One end 13*a* of the motor shaft 13 is forced through the bearing 22 mounted in the housing 14*a* with a press fit. The bottom position of the shaft 13 in the fixture 77 is shown in FIG. 15. The bottom shaft position is defined by the bottom 85 of a well 86 formed in the fixture 77. This action will also properly locate the rotor within the stator of the motor. second housing 14*b* is assembled to a bearing 22 in the same manner as illustrated in FIG. 12. The second housing 14*b* with its bearing 22 is then inserted over the opposite end 13*b* of the motor shaft 13 as shown in FIG. 16. The second housing 14*b* with its bearing 22 is forced over the end 13*b* of the motor shaft 13, and the rabbet 16 in the housing 14*b* engages with and is press fit onto the end 9 of the motor shell 10. In accomplishing this action, the bearing 22 in the second housing 14*b* is press fitted onto the motor shaft.

The assembly is complete by joining the two housings 14*a* and 14*b* with the one-piece head 63.

The one-piece head 63 is the principal attachment for the assembly because it requires the greatest load to completely separate the parts. The one-piece head 63 also serves to keep the housings from rotating with respect to each other, which could happen during shipment. The press fits at the bearing joints supply adequate motor to housing retention forces, but they cannot angularly align the housings with respect to each other. The motor shell to housing rabbet press fit supplies another level of insurance to keep the parts together and oriented, particularly during the assembly process before the one-piece head is attached.

During the cold press process, the press is set up to press on the second housing 14*b* and bearing 22 assembly while monitoring the press forces. The controls for the press determine the point at which the housing rabbet bottoms against the motor shell 10 by measuring the change in slope of the force curve. When that bottoming occurs, the press keeps pressing until a certain differential force is added for bearing preload. The press then stops and retracts.

The elimination of bolts and the use of cold pressing fits has several advantages. The bearing clearances can be tightened without causing assembly problems while at the same time helping to increase the housing retention forces. The elimination of the bolts reduces sound levels caused by bolt resonance. It also eliminates the opportunity for a bolt to touch the motor lamination and cause an annoying "buzz". Cold pressing without the use of bolts eliminates the variability in the bearing preload caused by the bolt loads. Instead, the bearing preload is only affected by the pressing forces.

We claim:

1. In a pump comprising at least two separate cylinder housings, each cylinder housing defining a cylinder with an axis, the axes being parallel and spaced apart; a pair of pistons, each piston being reciprocable in a corresponding one of the cylinders so as to reciprocate along the axis of the corresponding cylinder to vary a working volume of the cylinder; a motor positioned between the cylinder housings and driving the pistons so as to reciprocate the pistons; a pair of head members, each head member being fastened to a different one of the cylinder housings; and at least one tube spanning the head members, wherein the tube provides fluid communication between the head members;

the improvement wherein:

a monolithically formed head which is common to both of the cylinder housings and is a single piece of continuous material includes the head members and the tube so that the tube is joined to each head member with a fluid tight and fixed rigid connection provided by the material of the monolithic head continuously joining the tube to each head member, the head being rigid so as to assist securing the housings in a fixed orientation relative to one another.

2. The improvement of claim 1, further comprising another tube spanning the head members and providing fluid communication between the head members, and wherein the other tube is formed integrally with the head members as part of the single piece of continuous material of the monolithic head, the material of the monolithic head providing a fluid tight and fixed rigid connection between the other tube and each head member.

3. The improvement of claim 1, wherein the single piece of continuous material of the monolithic head defines a web which spans the tubes and is joined integrally with the tubes.

4. The improvement of claim 3, wherein the web is joined integrally directly with the head members.

5. The improvement of claim 1, wherein the motor is fixed between the cylinder housings without fasteners joining the motor to the cylinder housings.

6. The improvement of claim 5, further comprising a spacer sleeve between the cylinder housings and wherein a press fit connection joins the spacer sleeve and each of the cylinder housings.

7. The improvement of claim 5, further comprising a pair of bearings, one of the bearings being press fitted into each cylinder housing, and wherein each bearing is press fitted onto a shaft which is driven by the motor.

8. The improvement of claim 1, wherein the tube is spaced from the motor so as to provide an open space between the motor and the tube, said open space being adjacent to the tube.

9. The improvement of claim 1, wherein the head is monolithically cast of a metal material.

* * * * *